US006916515B1

(12) United States Patent
Almog et al.

(10) Patent No.: US 6,916,515 B1
(45) Date of Patent: Jul. 12, 2005

(54) METHOD OF PRODUCING TRANSFER SHEETS AND TRANSFER SHEETS

(75) Inventors: Yaacov Almog, Nes-Ziona (IL); Sergio Brandriss, Rehovot (IL); Amnon Levi, Gedera (IL)

(73) Assignee: Hewlett-Packard Company, Fort Collins, CO (US)

( * ) Notice: Subject to any disclaimer, the term of this patent is extended or adjusted under 35 U.S.C. 154(b) by 0 days.

(21) Appl. No.: 10/297,380

(22) PCT Filed: Jul. 10, 2000

(86) PCT No.: PCT/IL00/00407

§ 371 (c)(1),
(2), (4) Date: Dec. 5, 2002

(87) PCT Pub. No.: WO02/05036

PCT Pub. Date: Jan. 17, 2002

(51) Int. Cl.[7] ..... B41M 5/30

(52) U.S. Cl. ..... 428/32.51; 156/235; 428/32.77; 428/32.81

(58) Field of Search ..... 156/235; 428/32.51, 428/32.77, 32.8, 32.81, 32.12; 427/152; 503/227

(56) References Cited

U.S. PATENT DOCUMENTS

| | | | | |
|---|---|---|---|---|
| 4,661,431 A | | 4/1987 | Santos et al. | 430/126 |
| 4,754,294 A | | 6/1988 | Kato | 346/160 |
| 5,217,793 A | * | 6/1993 | Yamane et al. | 428/212 |
| 5,428,430 A | | 6/1995 | Aslam et al. | 355/272 |

FOREIGN PATENT DOCUMENTS

| | | |
|---|---|---|
| DE | 42 10 976 | 4/1993 |
| DE | 44 32 383 | 11/1995 |
| EP | 0 266 466 | 5/1988 |
| EP | 0 518 138 | 12/1992 |
| WO | WO 96/34319 | 10/1996 |
| WO | WO 99/19773 | 4/1999 |

OTHER PUBLICATIONS

DatabaseWPI; Section Ch; Week 199237; Derwent Publications Ltd.; AN 1992–303913;XP002162668; & JP 04–208978;Jul. 30, 1992; Imaeda, M.

DatabaseWPI; Section Ch; Week 200018; Derwent Publications Ltd.; AN 2000–200424;XP002162669; & JP 2000–037992; Feb. 8, 2000; Hatada, S. et al.

DatabaseWPI; Section Ch; Week 199744; Derwent Publications Ltd.; AN 1997–474968;XP002162670; & JP 09–220862; Aug. 26, 1997; Nozaki, T.

Okawa,A.; Patent Abstracts of Japan; vol. 1997; No. 4; Apr. 30, 1997 & JP 08–328389; Dec. 13, 1996.

* cited by examiner

*Primary Examiner*—B Hampton Hess

(57) ABSTRACT

A method of producing a transfer sheet containing an image for transfer to a final surface by heat and pressure, the method including: providing a transfer sheet; providing an image, for example a liquid toner image; and transferring an image to the transfer sheet, using heat and pressure.

50 Claims, No Drawings

METHOD OF PRODUCING TRANSFER SHEETS AND TRANSFER SHEETS

RELATED APPLICATIONS

The present application is a U.S. national application of PCT/IL00/00407 filed on Jul. 10, 2000.

FIELD OF THE INVENTION

The present invention is concerned with printing on heat transfer sheets and more particularly to preparation of such sheets for printing with toner.

BACKGROUND OF THE INVENTION

The use of plastic or coated paper transfer sheets is well known. An image is first printed on such a sheet and then, generally using a heat/pressure transfer process, the image is transferred to a final substrate, which may be a shirt, cup or other object. The image is fixed to the transfer sheet so that the sheet may be stored, handled, etc., without damage to the image. Often, the sheet is first coated with an interlayer to which the ink is attracted so that good printing onto the sheet is achieved. Generally, the bonding of the interlayer to the transfer sheet is purposely made poor enough so that during transfer to the final substrate, the ink, together with the underlayer, are transferred to the final substrate. Alternatively, the bond between the ink and the underlayer is weak enough so that the ink separates from the underlayer and transfers separately to the final substrate.

This process is to be distinguished from offset printing in which an intermediate transfer member is also used. In offset printing processes, the ink is not fixed to the intermediate member. In standard ink offset printing the ink layer on the intermediate member splits during transfer to a substrate, so that about half of the ink on the member transfers to the substrate to form the image. In toner offset processes, the image on the intermediate member is substantially completely transferred to the substrate, usually by heat and pressure. Alternatively or additionally, in some systems electrostatic fields are used to aid or effect transfer of the toner image.

The process of offset printing, and especially of toner offset printing, on transfer sheets has not been fully solved. In particular, when using liquid toner to print on a sheet, three different situations are known in the art:

1) To some sheet materials, such as paper and Teslin (polyethylene mixed with silica) transfer is good. However, fixing to those materials is usually so good that image transfer to a third substrate is usually unsuccessful.
2) Transfer to many materials is per se very difficult. For example, printing with liquid toner in which the toner particles are based on a copolymer of ethylene with methacrylic acid on most plastics such as bare polyester or polypropylene is difficult or impossible.
3) Treatment of plastics to improve spring of liquid toners thereon is known. However, such treatments, be they in the nature of surface treatments or coatings generally result in good fixing of the image to the substrate, such that transfer from the sheet is generally unsuccessful.

It should be understood that the processes described above are seldom perfect and, for example, there are many cases in which some of the ink or toner will transfer from the sheet to a final substrate. However, the image will not completely transfer or will tear and some of the image will remain on the sheet.

An exemplary system for permanently printing at least liquid toners on plastic sheets is described in WO 99/19773, the disclosure of which is incorporated herein by reference. This reference teaches, inter alia, the coating of a plastic sheet with two layers. The layer closest to the sheet is tightly bonded to the plastic sheet, but generally has a low affinity and/or bonding strength with the toner. An upper layer, bonds well to both the lower layer and the toner.

SUMMARY OF THE INVENTION

An aspect of some embodiments of the invention is concerned with the printing of images on transfer sheets, for subsequent transfer of the image to a final substrate.

In some embodiments of the invention, the images are tone images, for example, liquid toner images. In some image transfer processes and intermediate transfer member is used such that the image is transferred at least three times. A first transfer process comprises transfer of the image to an intermediate transfer member. The first transfer process may be electrostatically sided or effected and/or may be aid or effected by heat and/or some pressure. A second transfer process comprises transfer of the image to the transfer sheet. In exemplary embodiments of the invention, especially suited for toner image transfer, and especially for liquid toner transfer, second transfer is thermal, namely, by heat and pressure. In other embodiments it may be effected or aided by electrostatic forces.

It should be understood that during the second transfer process, there is a balance of forces between affinity of the image for the intermediate member and sheet. Furthermore, when a coating on the sheet is used to aid in overall process, the (imperfect) adhesion of the coating to the sheet must also be kept in mind. Such adhesion, while being low enough to allow for transfer to a final substrate, should be high enough so that during printing on the sheet, transfer to the image carrying surface does not occur. This can be especially problematic where heat and pressure are used in second transfer.

A third transfer process is one in which the image, optionally together with an underlying coating on the sheet, is transferred to a final substrate.

The inherent contradiction in this process is evident. During second transfer, heat and pressure are used to transfer the image to the sheet. This implies that the adhesion of the toner (together with that of any underlying coating of the sheet) be stronger than the bond to the intermediate transfer member. During third transfer, heat and pressure are again used to transfer the sheet to the image, optionally with the coating, from the sheet. This puts substantial limitations on the material that can be used to coat the sheet.

In some embodiments of the invention, a transfer sheet according to the following aspect of the invention is used.

An aspect of some embodiments of the present invention is concerned with the treating of a transfer sheet such that an image can be transferred and fixed to it, but which the image is transferable, by heat and pressure to a final substrate.

In some embodiments of the invention, the image is a toner image, for example a liquid toner image. In some embodiments, the transfer process by which the image is transferred to the sheet includes electrostatic transfer.

Generally, the sheet is plastic or has a plastic surface coating. It is generally impossible to achieve "clean" transfer of images from paper. In some embodiments of the invention, the treatment includes coating the sheet with a coating that has a good affinity for the toner but which has only a fair affinity for the underlying transfer sheet. Optimally, the coating should have a high cohesion, such that it transfers cleanly to the final substrate together with the image, which is often discontinuous. Furthermore, the coating should have a high enough affinity for the sheet so that it remains to the sheet, during the printing of the image to it.

The coating comprises a single layer. In some embodiments of the invention, the coating comprises at least two layers including, an outer layer on which the toner is printed, and an underlayer, which is attached to the surface of the sheet. This two-layer structure may allow for greater latitude in the choice of materials, since the two functions of the coating, namely the adhesion to the toner during printing on the transfer sheet and the release of the toner (optionally including at least part of the coating) during transfer of the image from it. Furthermore, in some cases the lower layer increases the cohesion of the layer, such that if the upper layer adheres at some point on its surface to the intermediate transfer member, the cohesion will act to pull the layer from the adhesion point or at the least will stop the propagation of any tear in the layer that may occur.

In some embodiments of the invention, the first and second coating layers both transfer to the final substrate with the image. In these embodiments, the bonding between the upper and underlayers is stronger than that of the underlayer to the substrate. Alternatively, in some embodiments of the invention, the underlayer does not transfer to the final substrate. However, the upper layer does transfer.

In some embodiments of the invention, the final substrate is coated with a primer layer. In general, the material of the second coating layer is suitable for use as such substrate. One primer which appears to be suitable for priming for all the examples given is amine terminated polyamine, such as Macromelt 6239 (Henkel Corporation).

There is thus provided, in accordance with an embodiment of the invention, a method of producing a transfer sheet containing an image for transfer to a final surface by heat and pressure, the method including:

providing a transfer sheet;

providing an image; and transferring an image to the transfer sheet, using heat and pressure.

There is further provided, in accordance with an embodiment of the invention, a method of producing a transfer sheet containing an image for transfer to a final surface by heat and pressure, the method comprising:

providing a transfer sheet;

providing a liquid toner image; and transferring the image to the transfer sheet.

In an embodiment of the invention, transferring the image comprises transferring the image to the transfer sheet, using heat and pressure.

Optionally, providing an image comprises producing an image using an electrostatic process.

Optionally, providing an image comprises producing a multicolor image. In an embodiment of the invention producing a multicolor image comprises:

producing a series of color separations; and transferring the separations seriatim to an intermediate transfer member.

In an embodiment of the invention, transferring the image to the transfer sheet comprises transferring the separations as a group from the intermediate transfer member to the transfer sheet. Alternatively, transferring the image to the transfer sheet comprises transferring the separations seriatim from the intermediate transfer method of the transfer sheet.

In an exemplary embodiment of the invention, the transfer sheet comprises:

a substrate;

an underlayer on the substrate that has a relatively weak affinity for the substrate, especially under heat; and an overlayer that has a strong affinity to the underlayer.

In an exemplary embodiment of the invention, during transferring of the image to the sheet, the underlayer has a higher affinity for the substrate than does the overlayer to a surface from which the image is transferred thereto.

There is further provided, in accordance with an exemplary embodiment of the invention, a thermal transfer sheet comprising:

a sheet of plastic material;

a coating on the sheet comprising an underlayer comprising a polymer chosen from the group consisting of a Polyvinyl Pyridine, a copolymer of vinyl pyridine and styrene and a polyethylene methacrylic acid copolymer, and an overlayer.

There is further provided, in accordance with an exemplary embodiment of the invention, a thermal transfer sheet comprising:

a sheet of plastic material;

a coating on the sheet comprising:

and underlayer, and an overlayer comprising a polymer chosen from the group consisting of an amine-terminated polyamide and a polyethylene imine.

In an exemplary embodiment of the invention, the underlayer comprises a polymer chosen from the group consisting of a Polyvinyl Pyridine, a Polyvinyl Pyridine co-styrene and a polyethylene methacrylic acid copolymer.

In an exemplary embodiment of the invention, the overlayer comprises an amine-terminated polyamide. Optionally, the overlayer comprises silica in an amount equal to greater than about 3% by weight. Alternatively, the silica is present in an amount between about 2%–10% by weight. Optionally the silica is present in an amount greater than 5%. In an exemplary embodiment, the silica is present in an amount about 10% by weight.

In an alternative embodiment of the invention, the overlayer comprises a polyethylene imine.

In exemplary embodiments of the invention, the overlayer has a weight per square meter of greater than or equal to about 10 $mg/m^2$. Alternatively or additionally the overlayer has a weight per square meter of less than or equal to about 3000 $mg/m^2$. In some embodiments of the invention, the overlayer has a weight per square meter of between about 20–300 $mg/m^2$.

In an exemplary embodiment of the invention, the underlayer comprises a linear Polyvinyl Pyridine. In some embodiments of the invention, the polyvinyl pyridine has a molecular weight of between about 40,000 and 200,000.

In alternative embodiments of the invention, the underlayer comprises a copolymer of vinyl pyridine and styrene. In exemplary embodiments, the copolymer of vinyl pyridine and styrene has a molecular weight of between 60,000 and 100,000.

Alternatively, the underlayer has a molecular weight of between 10,000 to 500,000.

In alternative embodiments of the invention, the underlayer comprises a polyethylene methacrylic acid copolymer. In an embodiment of the invention, the underlayer includes between about 2% and 10% silica.

In exemplary embodiments of the invention, the underlayer has a weight per square meter of greater than or equal to about 100 mg/m$^2$. Alternatively or additionally, the underlayer has a weight per square meter of less than or equal to about 3000 mg/m$^2$. In some embodiments of the invention, the underlayer has a weight of between about 300 and 600 mg/m$^2$.

In exemplary embodiments of the invention, the sheet includes an image formed on the overlayer. In exemplary embodiments of the invention, the image is a toner image. In some embodiments, the image is a liquid toner image.

DETAILED DESCRIPTION OF EXEMPLARY EMBODIMENTS

Successful experiments were carried out for printing on Corona treated polyester (PET) and untreated PET (EXCEL, Saehan, Korea). Seven different underlayers, in conjunction with two different outerlayers were tested. Not all combinations were tested and not all of the tested combinations gave satisfactory results.

In the experiments described below, the first and second transfer processes were performed using an Indigo Omnius® printer and Type 3.1 ElectroInk®. This toner contains particles based mainly on a copolymer of polyethylene and methacrylic acid (Nucrel 699 of DuPont). A plurality of color images are sequentially formed on a photoreceptor and transferred, in alignment to an intermediate transfer member. The images are transferred from the intermediate transfer member to the sheet, using heat (about 130° C.) and pressure (about 3 atmospheres). For ease of handling the plastic sheets were glued to a paper substrate. Other temperatures and pressures may be used in such processes. The intermediate transfer member is preferably coated with a material to which the toner has a relatively low adhesion, such as silicone. In the present examples, the difference in temperature between second and third transfer is about 20–35 degrees. However, higher and lower temperature differences may be used. Furthermore, as the adhesivity of the intermediate transfer member for the toner and overcoat is reduced, the temperature difference may be made smaller.

Table 1 is a table of transfer results for the four sheet materials for two layer coating systems in which the outer layer was an amine-terminated polyamide. The underlayers are either linear polyvinyl pyridine or polyvinyl co-styrene copolymer as indicated in the table. Both layers were approximately 0.3 gm/m$^2$.

The final substrate was a textile coated with amine-terminated polyamide. The transfer was effected at 130° C. and a pressure of atmospheres. The coating materials were all supplied by Scientific Polymer Products, Inc. Ontario, N.Y.

TABLE 1

| Undercoat - Polyvinyl Pyridine | Treated PET | PET |
|---|---|---|
| (2)linear; mw: 40,000 | 2 | 2 |
| (2)linear; mw: 200,000 | 4 | 3 |
| (4)linear; mw: 50,000 | 4 | 4 |
| (2)co-styrene; styrene 30%: mw: 110,000 | 3 | 3 |
| (4)co-styrene; styrene 10% | 5 | 5 |
| (4)co-styrene; styrene 50%: mw: 60000 | 5 | 4 |

The image was transferred to the final substrate using a hot laminator (Talboy's Engineering Corp. Ser 2072). The laminator was operated at 3 atmospheres pressure and 140° C. The laminator upper roll was elastic and it worked against a stanless steel polished roll.

For all cases printing on the substrate was good, with respect to transfer, 5 means that the result were good, 4 means that the results were completely acceptable, 3 means that small traces of the image remained on the transfer sheet, 2 means that small areas remained; 1 means that more substantial areas remained and 0 represents poor transfer.

Additional experiments were performed with other undercoatings and overcoatings with Untreated PET with the following results:

TABLE 2

| Undercoat | Overcoat | Results |
|---|---|---|
| Polyethylene methacrylic acid Copolymer + R972 10% 600 mg/m$^2$. | Polyethylene Imine 20 mg/m$^2$. | 3 |
| Polyethylene methacrylic acid Copolymer + R972 10% 600 mg/m$^2$. | Amine-terminated polyamide-125 mg/m$^2$. | 4–5 |
| Polyethylene methacrylic acid Copolymer + R972 10% 600 mg/m$^2$. | Amine-terminated polyamide + 3% $SiO_2$—7 micrometer 50 mg/m$^2$. | 4–5 |
| Polyethylene methacrylic acid Copolymer + R972 10% 600 mg/m$^2$. | Amine-terminated polyamide + 10% R972; 300 mg/m$^2$. | 4–5 |
| Polyethylene methacrylic acid Copolymer + R972 10% 600 mg/m$^2$. | Amine-terminated polyamide + 3% + R972 10%; 150 mg/m$^2$. | 4–5 |

Aerosil R972 is a trade name for nanometric size silica made by Degussa. The Polyethylene methacrylic acid Copolymer used (emulsion in water) was Michelman 4990. Applicants have found that the use of such material better controls the adhesion of the layers. The coatings can be applied by any method known in the art, such as wire rod coating, gravure coating, etc. Gravure coating is suitable when long rolls of plastic substrate are to be coated.

Third transfer was made to polyethylene tubing at 130° C. and a pressure of 3 Atmospheres.

Broadly speaking, the underlayer generally has a weight of between 300 and 600 mg/m2, although higher and lower weights, for example, 100–2000) can be used. Broadly speaking, the overlayer generally has a weight of between 20 and 300 mg/m2, although higher and lower weights, for example 10–3000) can be used.

Attempts were also made to point using only a single layer coating. In general these results were poor. However, printing directly on a polyvinyl pyridine (2) linear (mw:40000) coated non-treated PET substrate gave good results. The other underlayer/PET combinations gave results generally comparable to those of the two layer coated substrates. Printing on BOPP (Biaxially Oriented Polypropylene from Stilan Bimo, Italy) and Pearl (Polypropylene Pearl from Hoechst, Germany), variable results were achieved, depending on the particular layer and conditions.

The present invention has been described with respect to certain exemplary embodiments thereof. However, these embodiments are presented as support of the inventive concept described herein and defined by the claims. Thus, it should be understood that the broadest aspects of the invention are not limited by particular embodiments described herein. For example, while in the examples particular weights, molecular weights etc., have been used, the summary contains wider ranges of said parameters, which are also believed to be useful in the practice of the invention. Wider ranges of said parameters may be useful under particular circumstances.

As used in the specification and claims, the terms "comprise," "include," and "have" and their conjugates mean "including but not necessarily limited to."

What is claimed is:

1. A method of producing a transfer sheet containing an image for transfer to a final surface by heat and pressure, the method including:

providing an image directly on a first surface; and providing a transfer sheet, comprising a substrate;

an underlayer on the substrate that has a relatively weak affinity for the substrate, especially under heat; and an overlayer that has a strong affinity to the underlayer;

transferring an image to the overlayer of the transfer sheet from the first surface using heat and pressure, thereby fixing the image to the transfer sheet, wherein during transferring of the image to the sheet, the underlayer has a higher affinity for the substrate than does the overlay to a surface from which the image is transferred thereto.

2. A method according to claim 1 wherein the overlayer comprises an amine-terminated polyamide.

3. A method according to claim 2 wherein the overlayer comprises silica.

4. A method according to claim 3 wherein the silica is presented in an amount equal to greater than about 3% by weight.

5. A method according to claim 3 wherein the silica is present in an amount between about 2%–10% by weight.

6. A method according to claim 3 wherein the silica is present in an amount greater than 5%.

7. A method according to claim 6, wherein the silica is present in an amount about 10% by weight.

8. A method according to claim 1, wherein the overlayer comprises a polyethylene imine.

9. A method according to claim 1, wherein the overlayer has a weight per square of greater than or equal to about 10 $mg/m^2$.

10. A method according to claim 1, wherein the overlayer has a weight per square meter of less than or equal to about 3000 $mg/m^2$.

11. A method according to claim 1 wherein the overlayer has a weight per square meter of between about 20–30 $mg/m^2$.

12. A method according to claim 1 wherein the underlayer comprises a linear Polyvinyl Pyridine.

13. A method according to claim 12 wherein the polyvinyl pyridine has a molecular weight of between about 40,000 and 200,000.

14. A method according to claim 1 wherein the underlayer comprises a copolymer of vinyl pyridine and styrene.

15. A method according to claim 14 wherein the copolymer of vinyl pyridine and styrene has a molecular weight of between 60,000 and 100,000.

16. A method according to claim 11 wherein the underlayer has a molecular weight of between 10,000 to 500,000.

17. A method according to claim 1 wherein the underlayer comprises a polyethylene methacrylic acid copolymer.

18. A method according to claim 17 wherein the underlayer includes between about 2% and 10% silica.

19. A method according to claim 1 wherein the underlayer has a weight per square meter of greater than or equal to about 100 $mg/m^2$.

20. A method according to claim 1 wherein the underlayer has a weight per square meter of less than or equal to about 3000 $mg/m^2$.

21. A method according to claim 1 wherein the underlayer has a weight of between about 300 and 600 $mg/m^2$.

22. A method according to claim 1 wherein providing an image comprises:

producing an image using an electrostatic process.

23. A method according to claim 1 wherein providing an image comprises:

producing a multicolor image.

24. A method according to claim 23 wherein producing a multicolor image comprises:

producing a series of color separations; and transferring the separations seriatim to an intermediate transfer member.

25. A method according to claim 24 wherein transferring the image to the transfer sheet comprises:

transferring the separations as a group from the intermediate transfer member to the transfer sheet.

26. A method according to claim 24, wherein transferring the image to the transfer sheet comprises:

transferring the separations seriatim from the intermediate transfer member to the transfer sheet.

27. A thermal transfer sheet capable of receiving an image and transferring the image to a final substrate, the sheet comprising:

a sheet of plastic material;

a coating on the sheet comprising an underlayer comprising a polymer chosen from the group consisting of a Polyvinyl Pyridine a copolymer of vinyl pyridine and styrene and a polyethylene methacrylic acid copolymer, and an overlayer.

28. A thermal transfer sheet capable of receiving an image and transferring the image to a final substrate, the sheet comprising:

a sheet of plastic material;

coatings on the sheet comprising:

an underlayer, and, an overlayer comprising a polymer chosen from the group consisting of an amine-terminated polyamide and a polyethylene imine.

29. A sheet according to claim 28 wherein the underlayer comprises a polymer chosen from the group consisting of a Polyvinyl Pyridine a Polyvinyl Pyridine co-styrene as a polyethylene methacrylic acid copolymer.

30. A sheet according to claim 29 wherein the overlayer comprises a polyethylene imine.

31. A sheet according to claim 28 wherein the overlayer comprises an amine-terminated polyamide.

32. A sheet according to claim 31 wherein the overlayer comprises silica.

33. A sheet according to claim 32 wherein the silica is present in an amount equal to greater than about 2% by weight.

34. A sheet according to claim 32 wherein the silica is present in an amount less than or equal to about 10% by weight.

35. A sheet according to claim 28 wherein the overlayer has a weight per square meter of greater than or equal to about 10 $mg/m^2$.

36. A sheet according to claim 28 wherein the overlayer has a weight per square meter of less than or equal to about 3000 $mg/m^2$.

37. A sheet according to claim 28 wherein the overlayer has a weight per square meter of between about 20–300 $mg/m^2$.

38. A sheet according to claim 28 wherein the underlayer comprises a linear Polyvinyl Pyridine.

39. A sheet according to claim 38 wherein the polyvinyl pyridine has a molecular weight of between about 40,000 and 200,000.

40. A sheet according to claim 28 wherein the underlayer comprises a copolymer of vinyl pyridine and styrene.

41. A sheet according to claim 40 wherein the copolymer of vinyl pyridine and styrene has a molecular weight of between 60,000 and 100,000.

42. A sheet according to claim 40 wherein the underlayer has a molecular weight of between 10,000 to 500,000.

43. A sheet according to claim 28 wherein the underlayer comprises a polyethylene methacrylic acid copolymer.

44. A sheet according to claim 43 wherein the underlayer includes between about 2 and 10% silica.

45. A sheet according to claim 28 wherein the underlayer has a weight per square meter of greater than or equal to about 100 $mg/m^2$.

46. A sheet according to claim 28 wherein the underlayer has a weight per square meter of less than or equal to about 3000 $mg/m^2$.

47. A sheet according to claim 28 wherein the underlayer has a weight of between about 300 and 600 $mg/m^2$.

48. A sheet according to claim 28 and including an image formed on the overlayer.

49. A sheet according to claim 48 wherein the image is a toner image.

50. A sheet according to claim 49 wherein the image is a liquid toner image.

* * * * *